United States Patent [19]

Shonting

[11] 4,084,216

[45] Apr. 11, 1978

[54] SEWING MACHINE MAGNIFYING AND LIGHTING DEVICE

[76] Inventor: Homer R. Shonting, 1054 Eaglewood Rd., Apt. #2C, Annapolis, Md. 21403

[21] Appl. No.: 698,340

[22] Filed: Jun. 22, 1976

[51] Int. Cl.[2] ..... D05B 79/00

[52] U.S. Cl. ..... 362/90; 350/235

[58] Field of Search ..... 240/2.14, 2 M, 2.12, 240/2.17, 2 R, 1 R; 112/1, 257; 350/244, 235–238

[56] References Cited

U.S. PATENT DOCUMENTS

| | | | |
|---|---|---|---|
| 294,171 | 2/1884 | Watts | 350/244 |
| 879,003 | 2/1903 | Rhodes | 350/244 |
| 1,783,278 | 12/1930 | Brady | 350/235 X |
| 1,927,520 | 9/1933 | Lafans | 350/235 X |
| 1,960,114 | 5/1934 | Lindsay | 240/2 M X |
| 2,199,107 | 4/1940 | Kibbe | 350/235 X |
| 2,271,194 | 1/1942 | Ingwer et al. | 240/2.14 X |
| 2,286,492 | 6/1942 | Langille | 240/2.14 |
| 2,481,450 | 9/1949 | Schwartz | 240/2.14 X |
| 2,795,997 | 6/1957 | Allen | 240/2 M X |
| 3,361,513 | 1/1968 | Fantazos | 350/244 |

*Primary Examiner*—Richard L. Moses
*Attorney, Agent, or Firm*—Arthur Schwartz

[57] ABSTRACT

A magnifying device for a sewing machine includes a clamp engaging onto a head of the sewing machine. A joining bar is affixed onto the clamp member. A pair of extension rods are hingably joined to the joining bar by a hinge element. A rectangular shaped frame member has a magnifying lens mounted therein. A pair of bearing blocks are mounted on the frame, wherein each extension rod is journaled within one of the bearing blocks. A light shade member is mounted on the frame, wherein a light socket and light are mounted within the shade member.

8 Claims, 2 Drawing Figures

SEWING MACHINE MAGNIFYING AND LIGHTING DEVICE

BACKGROUND OF THE INVENTION

A number of U.S. Patents relates to light means for illumination of the sewing area of a sewing machine. These patents are U.S. Pat. Nos. 2,534,037 to Langille; 2,596,598 to Redlich; 3,049,612 to Sasaki; and 2,598,452 to Singer. These patents are non related to the adjustable magnifying device of the present invention.

SUMMARY OF THE INVENTION

My present invention relates to a magnifying device for a sewing machine.

An object of my present invention is to provide a magnifying device for a sewing machine thereby allowing person's with poor vision to readily observe their work.

A further object of my present invention is to provide a light means for illuminating the area of magnification.

A still further object of my present invention is to provide a means for moving the magnifying lenses relative to the head of the sewing machine.

Briefly, my present invention comprises a clamp member engaging a head of a sewing machine. A joining bar communicates with the clamp member. A pair of extension rods are joined to the joining bar by a hinge element. A rectangularly shaped frame member has a magnifying lense member disposed within said frame member. A pair of bearing blocks are mounted on the frame, wherein the free end of each extension rod is disposed within one of the bearing blocks. A light shade is mounted on the frame, wherein a light means is mounted within the shade.

BRIEF DESCRIPTION OF THE DRAWING

The objects and features of the invention may be understood with reference to the following detailed description of an illustrative embodiment of the invention, taken together with the accompanying drawings in which.

DETAILED DESCRIPTION OF THE PREFERRED EMBODIMENT

Figure 1:
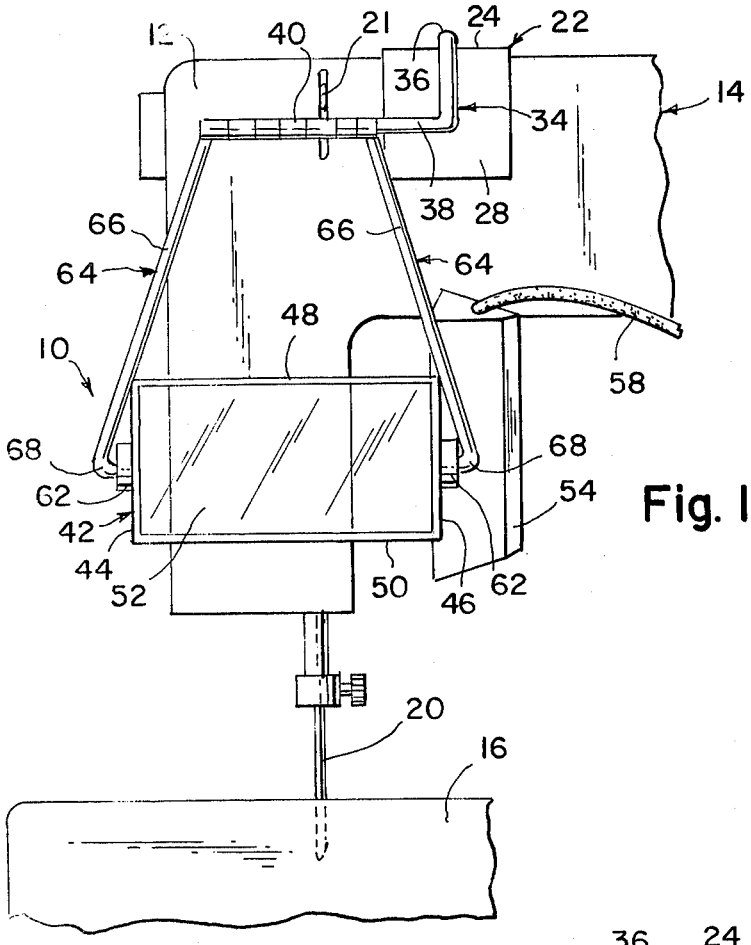
FIG. 1 illustrates a front planar view of the magnifying device mounted onto a sewing machine.
Figure 2:
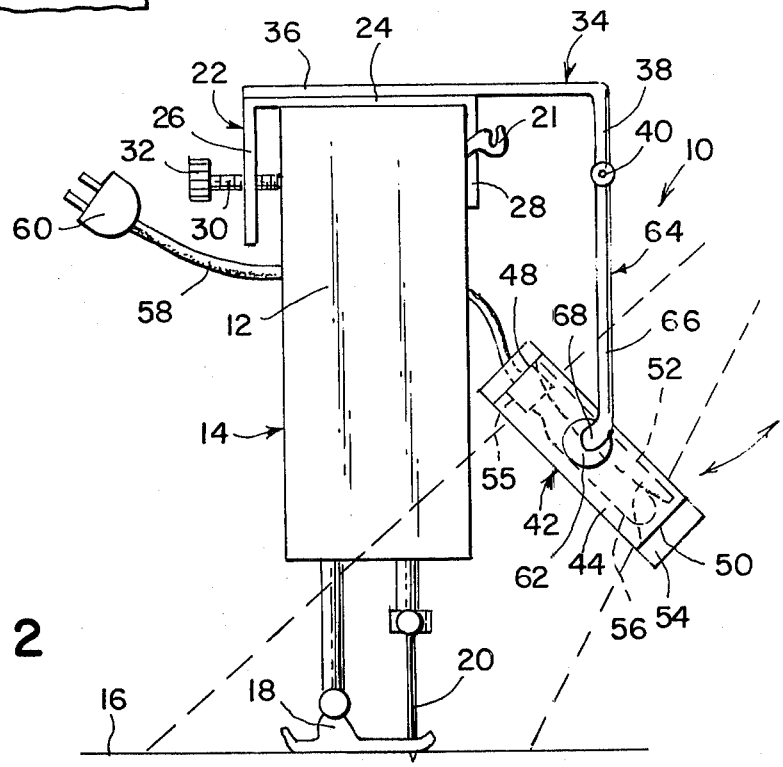
FIG. 2 illustrates an end view of the device mounted on the sewing machine.

Turning now descriptively to the drawings, in which similar reference characters denote similar elements throughout the several views, FIGS. 1–2 show a magnifying device 10 adapted to be mounted onto a forward upper head 12 of a sewing machine 14, wherein the range of magnification viewing is directed onto the base 16, the presser foot 18 and needle 20 of the sewing machine 14, wherein the head 12 of the sewing machine 14 has a take up lever 21 for the thread. The device 10 comprises a clamp member 22 having an elongated center section 24 and a pair of end arms 26, 28, wherein the arms 26, 28 are perpendicularly joined to the ends of the center section 24 such that both arms 26, 28 are aligned on the same side of the center section 24. A screw member 30 having an enlarged head 32 threadably extends through one arm 26. The center section 24 is adapted to engage an upper surface of the head 12 while the screw member 30 engages one vertical side of the head 12 and the other arm 28 engages a second vertical side of the head 12. A L-shaped joining bar member 34 has a longer leg 36 and a shorter leg 38, wherein the longer leg 36 is integrally joined onth the upper surface of the center section 24 of clamp member 22, wherein the shorter leg 38 is disposed outside of arm 28. A hinge member 40 is integrally joined to the outer end of the shorter leg. A rectangularly shaped frame member 42 has a pair of sides 44, 46 and a pair of ends 48, 50. A rectangularly shaped magnifying lense member 52 is mounted within the frame member 42. A light shade member 54 is mounted on one end 46 of the frame member 42 wherein a light socket 55 with a light 56 is disposed within the shade member 54. An electric cord member 58 with receptacle 60 communicates with the socket 55. On each end 42, 46 of the frame member 42 is mounted a bearing block member 62. An L-shaped extension rod member 64 communicates between each bearing block member 62 and each end of the hinge member 40. The longer leg 66 of each rod member 64 is joined to one end of the hinge member 40. The shorter leg 68 of each rod member 64 is journaled within each bearing block member 62.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A magnifying device adapted to be mounted onto a forward upper head of a sewing machine for magnification of a sewing area on a base of said sewing machine, which comprises:

a. an adjustably positioned clamp member adapted to engage onto said head of said sewing machine, b. a joining bar communicating with said clamp member, c. a frame member, d. a magnifying lens member disposed within said frame, e. a pair of extension rods, f. first means having an axis of rotation for rotatably joining each said extension rod to said frame including a pair of bearing block members mounted on said frame, each said bearing block receiving one of said extension rods therein, g. second means having an axis of rotation and positioned adjacent the upper head of said sewing machine for rotatably joining each said extension rod to said joining bar, h. wherein said axes of rotation are substantially parallel to each other.

2. A device according to claim 1, wherein said second rotatable joining means is a hinge member.

3. A device according to claim 1, further comprising:

a light shade mounted on said frame; and a light means disposed with said shade.

4. A device according to claim 1, wherein said frame member is rectangularly shaped.

5. A device according to claim 1, wherein said joining bar is L-shaped.

6. A device according to claim 1, wherein said clamp member further comprises:

a center section, a pair of end arms perpendicularly joined to the distal ends of said center section; and a screw member threadably extending through one of said arms.

7. A magnifying and lighting combination adapted to be mounted on a sewing machine head for magnification and illumination of a sewing area comprising:

a. a clamp means for adjustably engaging the sewing machine head, b. a frame member, c. a magnifying lens disposed within said frame, d. a light shade positioned on said frame and movable therewith, and an electric light positioned in said shade, e. means for pivotally connecting said frame member to said clamp for jointly magnifying and illuminating the sewing area, f. said frame including a pair of bearing block members, one on each side thereof, said light and light shade being mounted adjacent one of said bearing block members, a pair of extension rods pivotally mounted in said bearing block members, a joining bar connected to said clamp, said extension rods being rotatably connected to said joining bar whereby said magnifying lens and light can move together in an arc relative to a portion of said joining bar and rotate about said bearing block members.

8. The combination of claim 7 wherein said pivotally connecting means includes means for moving said frame member with said lens and said light thereon in an arc about a point displaced from said frame member and about a point secured to said frame member.

* * * * *